United States Patent [19]

Goloff

[11] 4,026,612

[45] May 31, 1977

[54] LUBRICATION OF SEALS IN ROTARY MECHANISMS

[75] Inventor: Alexander Goloff, East Peoria, Ill.

[73] Assignee: Caterpillar Tractor Co., Peoria, Ill.

[22] Filed: Mar. 22, 1976

[21] Appl. No.: 668,992

[52] U.S. Cl. ..... 308/106; 308/121; 418/60

[51] Int. Cl.[2] ..... F01C 1/02

[58] Field of Search ..... 418/60, 61; 123/196; 308/78, 106, 121

[56] References Cited

UNITED STATES PATENTS

| | | | |
|---|---|---|---|
| 3,098,605 | 7/1963 | Bentele et al. | 418/60 |
| 3,280,812 | 10/1966 | Peras | 418/60 |
| 3,343,526 | 9/1967 | Peras | 123/196 |
| 3,366,317 | 1/1968 | Keylwert | 418/60 |
| 3,694,113 | 1/1971 | Jones et al. | 418/60 |

*Primary Examiner*—Joseph F. Peters, Jr.
*Assistant Examiner*—Richard A. Bertsch
*Attorney, Agent, or Firm*—Wegner, Stellman, McCord, Wiles & Wood

[57] ABSTRACT

A rotary mechanism comprising a housing defining an operating chamber, a shaft journalled in the housing and having an eccentric within the chamber, the shaft including an oil passage adapted to receive oil under pressure from a pump or the like and terminating in an opening in the periphery of the eccentric. A rotor is located within the chamber and is journaled on the eccentric and mounts a plurality of seals sealingly engaging the housing at spaced locations and includes plural lubricating conduits for directing oil to at least some of the seals. The conduits terminate in spaced ports facing the eccentric and alignable with the opening therein. An annular bearing is interposed between the eccentric and the rotor to minimize friction thereat. A port extends through the bearing for establishing fluid communication between the opening and the rotor ports. The bearing further includes an annular, radially inwardly opening, oil distributing groove alignable with the opening and a dam in the groove about the bearing port.

5 Claims, 4 Drawing Figures

LUBRICATION OF SEALS IN ROTARY MECHANISMS

BACKGROUND OF THE INVENTION

This invention relates to rotary mechanisms and, more specifically, to improved lubrication systems for rotary mechanisms.

Structures exemplary of the prior art are illustrated in U.S. Pat. No. 3,280,812 and 3,343,526 to Peras.

Relatively short seal life has been a substantial impediment to the large scale use of rotary mechanisms as, for example, rotary engines, compressors, pumps, expanders, or the like. Notwithstanding improvements made through the use of expensive and exotic materials in forming the seals, it has been necessary to provide a means for lubricating such seals to extend their useful life.

In some instances, lubricant has been mixed with the fluid to be worked upon for such lubrication purposes, while in others, such as exemplified in the above identified Peras patents, lubricant has been directed at the seals, whether mounted on a rotor or mounted on the housing.

Frequently, where the seals are carried in grooves in the rotor, the oil is directed to the seal receiving grooves.

The foregoing approaches, while minimizing seal wear, are not altogether satisfactory in that no adequate means for metering the amount of oil directed to the seals has been provided. As a consequence, in order to ensure lubrication, in most instances the seals have been overlubricated resulting in high oil consumption.

SUMMARY OF THE INVENTION

It is the principal object of the invention to provide a new and improved rotary mechanism. More specifically, it is an object of the invention to provide such a mechanism with a means for lubricating seals employed therein without causing excessive oil consumption.

An exemplary embodiment of the invention achieves the foregoing object in a structure whereby the amount of lubricating oil directed to seals can be metered responsive to mechanism speed.

An exemplary embodiment includes a housing defining an operating chamber with a shaft journalled in the housing and having an eccentric within the chamber. The shaft includes an oil passage adapted to be in fluid communication with a source of oil under pressure and terminating in an opening in the periphery of the eccentric. A rotor is disposed within the chamber and is journalled on the eccentric and mounts a seal sealingly engaging the housing. The rotor includes a lubricating conduit directing oil to the seal and the conduit terminates in a port facing the eccentric and alignable with the opening therein. An annular bearing is interposed between the eccentric and the rotor to minimize friction therebetween and the bearing includes a port extending therethrough. One of the bearing and the rotor includes an annular, radially inwardly opening, oil distributing groove and there is provided a dam in the groove about the port in the one of the rotor and the bearing having the groove. As a consequence, during operation of the mechanism, periodically the opening in the eccentric will line up with the port in the bearing and the port in the rotor to direct oil into the rotor conduit. At all other times, lubricant flow to the rotor conduit will be blocked. By appropriate selection of pressure at the oil pump or source and dimensioning of the ports, oil quantities can be metered. The system, because of the geometry resulting in such periodic alignment, is self-compensating for speed of the mechanism.

In a highly preferred embodiment, the groove is located in the bearing and the dam is disposed about the bearing ports.

Frequently, several conduits will be located in the rotor for serving respective ones of the seals.

Another embodiment of the invention contemplates in a mechanism including an operating chamber, a shaft and a rotor as aforesaid, the use of an annular bearing interposed between the eccentric and the rotor to minimize friction with the bearing including a port extending therethrough for establishing fluid communication between the oil opening in the eccentric and the oil ports in the rotor. The openings and the ports are axially displaced from the center of the bearing and closely adjacent a side thereof whereby pressure in the rotor conduits, and thus oil flow, will be minimal at all times except when the ports are aligned.

Other objects and advantages will become apparent from the following specification taken in connection with the accompanying drawings.

DESCRIPTION OF THE PREFERRED EMBODIMENT

Figure 1:
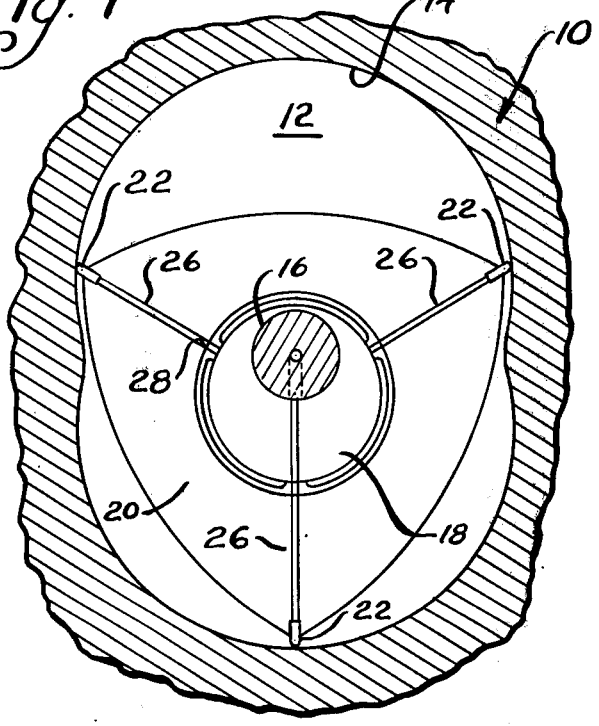
FIG. 1 is a somewhat schematic sectional view of a rotary mechanism, namely, a trochoidal mechanism, embodying the invention.

An exemplary embodiment of the invention is illustrated in the drawings in connection with a rotary mechanism in the form of a trochoidal mechanism. However, it is to be understood that the invention is not limited to trochoidal mechanisms, but will find utility in other forms of rotary mechanisms as, for example, slant axis rotary mechanisms. Similarly, it will be appreciated by those skilled in the art that the invention is not limited to any particular use of the rotary mechanism but will find utility in such mechanisms whether employed as engines, compressors, pumps, expanders, or the like.

An exemplary embodiment of a rotary mechanism made according to the invention includes a housing, generally designated 10, providing walls 12 (only one of which is shown) and 14 which, in turn, define an operating chamber. A shaft 16 is suitably journalled in the walls 12 to extend through the operating chamber and includes an eccentric 18 within the operating chamber. A rotor 20 of generally triangular configuration is journalled on the eccentric 18 and, at its apices, mounts apex seals 22 in conventional grooves.

Figure 2:
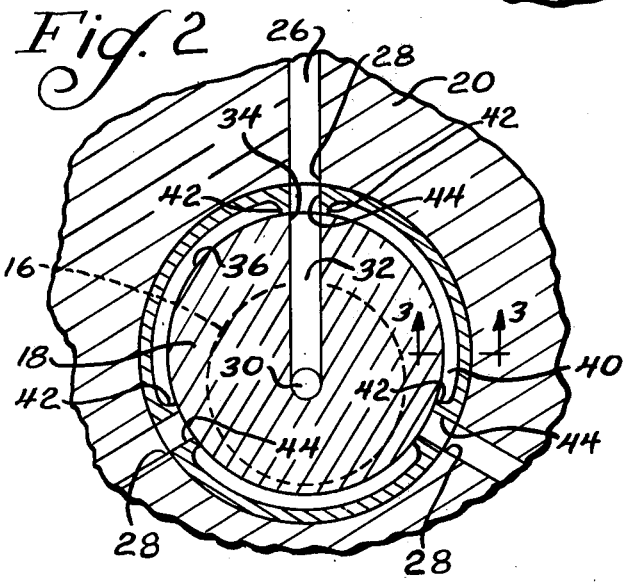
FIG. 2 is a fragmentary, enlarged sectional view of the rotor and eccentric interface.

As seen in FIG. 2, an annular bearing 24 is disposed at the interface of the rotor 20 and the eccentric 18 to minimize friction thereat. As seen in FIG. 1, the rotor 20 is provided with a plurality of lubricant-receiving conduits 26 which extend generally radially within the rotor 20 to open in, for example, the bottoms of the grooves (not shown) mounting the apex seals 22.

Each of the conduits 26 also opens in a port 28 facing the eccentric 18. Thus, oil entering the port 28 will pass through the associated conduit 26 to the associated seal 22 to lubricate the same.

Referring to FIG. 2, the shaft 16 includes an axial bore 30 which, by conventional means, may be associated with a source of lubricating oil under pressure, typically an oil pump (not shown). At the eccentric 18, the bore 30 intersects a radially extending bore 32 which extends to an opening 34 in the periphery 36 of the eccentric 18.

Figure 3:
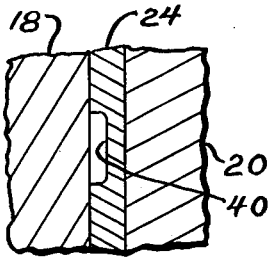
FIG. 3 is a sectional view taken approximately along the line 3—3 of FIG. 2.

As best seen in FIGS. 2 and 3, the bearing 24 is provided with an annular, radially inwardly opening, oil directing groove 40. The groove 40 extends about virtually the entirety of the interior of the bearing 24 but is stopped short by dams 42 surrounding through bores or ports 44 in the bearing 24. The inner diameter of the dams 42 is substantially equal to the outer diameter of the eccentric so that oil under pressure can be directed to the through bore 44 only when the opening 34 is aligned with the through bore 44. At all other times, oil under pressure from the bore 32 will be directed to the groove 40 to lubricate the interface of the bearing and the eccentric.

During the short interval of alignment as aforesaid, the oil under pressure will be directed to the interior of the conduit 26 to be ultimately directed to a corresponding one of the seals 22 for lubrication purposes. Thus, it will be appreciated that by selecting the pressure and by appropriately regulating the geometry, particularly that of the angular length of the through bore 44, a predetermined quantity of oil can be directed to the associated seal 22 for lubrication purposes.

It will also be observed that the system is self-compensating for the speed of the mechanism. For example, as mechanism speed picks up, alignment of the opening and the ports will occur more frequently with the consequence that more oil will be delivered in a given period of time.

If necessary, check valves may be associated with the conduits 26 to prevent back flow of oil and/or compressed fluid. The provision of such check valves forms no part of the present invention.

Figure 4:
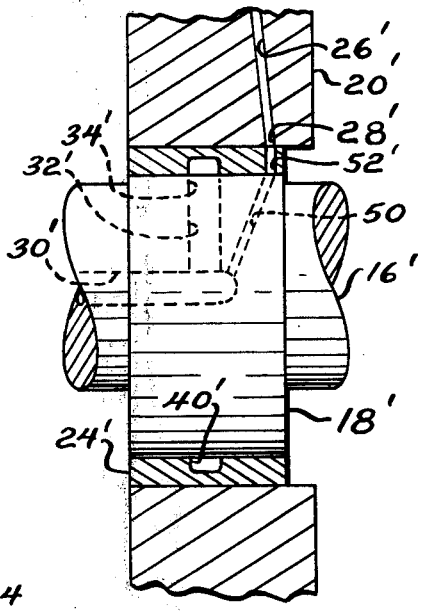
FIG. 4 is an enlarged, fragmentary sectional view of a modified embodiment of the invention.

FIG. 4 illustrates a modified embodiment of the invention. Where like parts are employed, they will be identified by like, but primed, reference numerals.

The shaft 16' includes an axial bore 30' which is in fluid communication with a radial bore 32' which opens to the periphery of the eccentric 18' at an opening 34'. The opening 34' is alignable with an annular, radially inwardly opening groove 40' in the bearing 24'. However, the bearing 24' is not provided with a through bore as the through bore 44 according to this embodiment.

An additional, generally radially extending bore 50 is in fluid communication with the axial bore 30' and is periodically alignable with a through bore 52' in the bearing 24' which, in turn, is aligned with a conduit 26' in the rotor 20'. It is to be noted that the alignment of the bore 50, the through bore 50' and the conduit 26' adjacent the eccentric 18' is remote from the center of the bearing 24' and closely adjacent an edge thereof. As a consequence of this construction, the only time lubricant under any substantial pressure will be directed to the conduits 26' will be when the bore 50 is aligned with the through bore 52'. At all other times, pressure will be substantially zero, including oil film pressure, by reason of the disposition of the elements adjacent an edge of the bearing. Accordingly, only a very short pulse of pressurized oil will exist and close control over oil consumption can be maintained since any flow of oil caused by oil film pressure in the bearing is substantially eliminated.

The invention also lends itself to use in systems where oil supply pressure varies, either intentionally, or as the result of inherent characteristics of the pumping mechanism. In such systems, very close control of very minute quantities of oil for lubricating purposes can be maintained. Moreover, this characteristic of the invention provides great flexibility in selecting pumping systems.

For example, those skilled in the art will recognize that certain types of gear pumps have been regarded as undesirable because the oil delivered under pressure is at very unsteady pressures. Stated another way, the monitoring of oil pressure would resemble a series of pressure spikes.

In a mechanism made according to the invention, bursts of high oil pressure can be provided through the use of such pumps and in view of the short time interval when the various ports and openings are in register, depending upon the specific pump, only one in five or ten revolutions will port and opening registry occur during a high pressure pulse, and only then will oil be delivered to the corresponding one of the seals for lubrication purposes. Thus, control is provided whereby only very minute quantities of oil are consumed.

What is claimed is:

1. In a rotary mechanism, the combination of:

a housing defining an operating chamber;

a shaft journalled in said housing and having an eccentric within said chamber, said shaft including an oil passage adapted to be in fluid communication with a source of oil under pressure and terminating in an opening in the periphery of said eccentric;

a rotor within said chamber and journalled on said eccentric, said rotor mounting a seal sealingly engaging said housing and including a lubricating conduit for directing oil to said seal, said conduit terminating in a port facing said eccentric and alignable with said opening;

an annular bearing interposed between said eccentric and said rotor to minimize friction thereat, said bearing including a port extending therethrough;

one of said bearing and said rotor including an annular, radially inwardly opening, oil distributing groove and a dam in said groove about the port in the one of the rotor and the bearing having the groove.

2. The rotary mechanism of claim 1 wherein the groove is in said bearing and said dam is about said bearing port.

3. A rotary mechanism comprising:

a housing defining an operating chamber;

a shaft journalled in said housing and having an eccentric within said chamber, said shaft including an oil passage adapted to receive oil under pressure and terminating in an opening in the periphery of said eccentric;

a rotor within said chamber and journalled on said eccentric, said rotor mounting a plurality of seals sealingly engaging said housing at spaced locations and including plural lubricating conduits for directing oil to at least some of said seals, said conduits terminating in spaced ports facing said eccentric and alignable with said opening; and an annular bearing interposed between said eccentric and said rotor to minimize friction therebetween;

said bearing including a port extending therethrough and adapted to establish fluid communication between said opening and said rotor ports, said bearing further including an annular, radially inwardly opening, oil distributing groove and a dam in said groove about said bearing port.

4. A rotary mechanism comprising:

a housing defining an operating chamber;

a shaft journalled in said housing and having an eccentric within said chamber, said shaft including an oil passage adapted to receive oil under pressure and terminating in an opening in the periphery of said eccentric;

a rotor within said chamber and journalled on said eccentric, said rotor mounting a plurality of seals sealingly engaging said housing at spaced locations and including plural lubricating conduits for directing oil to at least some of said seals, said conduits terminating in space ports facing said eccentric and alignable with said opening; and an annular bearing interposed between said eccentric and said rotor to minimize friction thereat, said bearing including a port extending therethrough for establishing fluid communication between said opening and said rotor ports, said opening and said ports being axially displaced from the center of said bearing and closely adjacent a side thereof.

5. The rotary mechanism of claim 4 wherein said eccentric includes a further opening connected to said oil passage, said further opening being relatively centrally located relative to said bearing; and wherein said bearing includes an annular, radially inwardly opening, oil distributing groove aligned with said further opening.

* * * * *